US007144087B2

(12) United States Patent
Haroldsen et al.

(10) Patent No.: US 7,144,087 B2
(45) Date of Patent: Dec. 5, 2006

(54) SYSTEMS AND METHODS FOR MILLING PAVING MATERIAL WITH INCREASED STABILITY, SUPPORT, AND POWER

(75) Inventors: J. Tron Haroldsen, Herriman, UT (US); Jeremy K. Nix, Provo, UT (US)

(73) Assignee: Asphält Zipper, Inc., Salt Lake City, UT (US)

( * ) Notice: Subject to any disclaimer, the term of this patent is extended or adjusted under 35 U.S.C. 154(b) by 0 days.

(21) Appl. No.: 10/336,289

(22) Filed: Jan. 3, 2003

(65) Prior Publication Data

US 2003/0127905 A1 Jul. 10, 2003

Related U.S. Application Data

(60) Provisional application No. 60/348,063, filed on Jan. 9, 2002.

(51) Int. Cl.
*E01C 23/088* (2006.01)
*E21C 27/32* (2006.01)

(52) U.S. Cl. ..... 299/39.1; 299/39.4; 299/39.8; 404/94

(58) Field of Classification Search ..... 299/36.1, 299/39.1, 39.4, 39.6, 39.8; 404/93, 94
See application file for complete search history.

(56) References Cited

U.S. PATENT DOCUMENTS 3,732,023 A * 5/1973 Rank et al. ..... 404/90
3,778,110 A * 12/1973 Staab ..... 299/39.5
3,779,607 A * 12/1973 Staab ..... 299/39.4
4,262,966 A * 4/1981 Bouplon ..... 299/39.8
4,545,700 A * 10/1985 Yates ..... 404/75
4,637,753 A * 1/1987 Swisher, Jr. ..... 404/90
4,793,730 A * 12/1988 Butch ..... 404/77
4,826,352 A * 5/1989 Adams, III ..... 404/90
4,900,094 A * 2/1990 Sergeant ..... 299/39.6
4,946,307 A * 8/1990 Jakob ..... 404/92
5,000,615 A * 3/1991 Murray ..... 404/75
5,388,893 A * 2/1995 Maxwell et al. ..... 299/39.6
5,484,228 A * 1/1996 Thomas et al. ..... 404/90
5,639,180 A * 6/1997 Sulosky et al. ..... 404/17
5,695,255 A * 12/1997 LeBlond ..... 299/39.1
5,775,781 A * 7/1998 Sawtelle et al. ..... 299/39.8
5,893,677 A * 4/1999 Haehn et al. ..... 404/90
6,019,433 A * 2/2000 Allen ..... 299/39.3
6,033,031 A * 3/2000 Campbell ..... 299/39.1
6,116,699 A * 9/2000 Kaczmarski et al. ..... 299/39.5
6,176,551 B1 * 1/2001 Page ..... 299/39.1
6,227,620 B1 * 5/2001 Page ..... 299/39.4
6,364,419 B1 * 4/2002 Cannizzo et al. ..... 299/39.6
6,402,252 B1 * 6/2002 Dickson ..... 299/39.6
6,612,773 B1 * 9/2003 Gray ..... 404/94
2004/0005190 A1 * 1/2004 Jakits ..... 404/475

* cited by examiner

*Primary Examiner*—David Bagnell
*Assistant Examiner*—Shane Bomar
(74) *Attorney, Agent, or Firm*—Kirton & McConkie; Michael F. Krieger

(57) ABSTRACT

Systems and methods for milling paving material. A self-powered milling system includes a cutting head to mill the paving material. The cutting head is powered by a milling system motor that speeds up production and enables the milling of very thick asphalt in a single pass. A milling system carriage follows the contour of the ground, provides stability during the milling process, is selectively adjusted to provide cuts at various angles, and enables precise edge milling. A breaker bar holds the paving material down as it tries to lift up during the milling process, and is employed to assist in the breaking up of the milled aggregate.

26 Claims, 7 Drawing Sheets

SYSTEMS AND METHODS FOR MILLING PAVING MATERIAL WITH INCREASED STABILITY, SUPPORT, AND POWER

RELATED APPLICATIONS

This application claims priority to U.S. Provisional Application Ser. No. 60/348,063, filed Jan. 9, 2002, and entitled, "Systems and Methods for Milling Paving Material with Increased Stability, Support, and Power," which is incorporated by reference herein.

BACKGROUND

1. Field of the Invention

The present invention relates to systems and methods for milling paving material. More particularly, the present invention relates to systems and methods that provide increased stability, support and power while grinding paving material.

2. Background of the Invention and Related Art

Asphalt milling is a technique currently employed to remove asphalt pavement for reconstruction or resurfacing, and for accessing buried utility lines. The technique involves the removal of asphalt pavement through the use of a cold planer, which can remove up to approximately two inches of pavement surface during a particular pass.

A cold planer typically includes a barrel-like attachment, referred to as a mandrel, and a variety of bits that are affixed to the exterior surface of the mandrel. Coupled to the cold planer is a vehicle (e.g., a bobcat or skid-steer) that is used to propel the cold planer. The mandrel rotates and is pushed into the pavement by the hydraulic system of the vehicle, causing the bits to grind up the asphalt pavement. The vehicle pushes the cold planer as the mandrel rotates to grind a trench in the asphalt pavement that is typically up to 24 inches wide.

While this technique enables the creation of a trench that is up to 2 inches deep, various problems exist. For example, traditional cold planers stall out upon attempting to grind 2–3 inches of asphalt pavement. Thus, when desiring to mill a depth of 6 inches of pavement, at least three passes of the cold planer must be conducted. Furthermore, the milled asphalt composite left behind in the wake of the cold planer must be removed between each pass. As a result, this process has proven to be time consuming.

The process is further delayed by the requirement of having to push the cold planer at an extremely slow rate. Much of the power from the skid-steer is used to rotate the mandrel. As such, limited power is available to push the cold planer forward. Typically, the cold planer creates a trench by grinding the pavement at a rate of up to ½ mph.

The process is further hampered by instability. The vehicle used to propel the cold planer typically loses traction and has a tendency to shake. A loss in pressure between the actions of providing pressure on the cold planer and lowering the mandrel also yields to instability. Moreover, a procedure of edge milling typically requires the removal of supporting structures of the cold planer, triggering further instability.

Thus, while the traditional technique of asphalt milling enables the creation of a milled trench that is up to 2 inches deep, the technique has proven to be instable and time consuming. Accordingly, it would be an improvement in the art to augment or even replace existing techniques to enable a trench to be milled in asphalt pavement at a quicker rate and/or to provide increased stability to the milling process.

SUMMARY AND OBJECTS OF THE INVENTION

The present invention relates to systems and methods for milling paving material. More particularly, the present invention relates to systems and methods that provide increased stability, support and power while grinding paving material.

Implementation of the present invention takes place in association with a self-powered milling system for use in milling or grinding asphalt and is configured for coupling to a vehicle (e.g., a bobcat, steer-skid, or other vehicle) that selectively pushes or pulls the milling system in a desired direction. The milling system includes a cylindrical mandrel, having a variety of bits attached thereon, which spins on an axis to break up and mill the asphalt. The mandrel is powered by a milling system motor that speeds up production and enables milling of very thick asphalt (e.g., 8 inch thick asphalt) in a single pass. A breaker bar of the milling system is continuously located at or near ground level during the milling process to hold the asphalt down as it tries to lift up during the process. The breaker bar further assists in breaking up the milled asphalt aggregate.

In one implementation, the milling system includes a carriage that follows the contour of the ground. The carriage provides stability during the milling process, allowing only the mandrel or cutting head to move during the process. The carriage may be selectively adjusted to provide cuts at various angles. Furthermore, the carriage is designed to include a flush side to enable use of the milling system in performing precise edge milling of the asphalt.

While the methods and processes of the present invention have proven to be particularly useful in providing increased stability, support and power in the area of milling asphalt, those skilled in the art shall appreciate that the methods and processes can be used to mill a variety of different surfaces.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof, which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1A through 5, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention relates to systems and methods for milling paving material. More particularly, the present invention relates to systems and methods that provide increased stability, support and power while grinding paving material.

In the disclosure and in the claims the term "paving material" shall refer to any material that may be used to pave a road, path, sidewalk, parking lot, driveway, thoroughfare, or any other similar surface. Examples of paving materials include asphalt, tarmac, pavement, cement, clay, stone and dirt.

Embodiments of the present invention take place in association with a self-powered milling system for use in milling or grinding paving material, and which may be configured to be coupled to a vehicle (e.g., a bobcat, steer-skid, back hoe, excavator or other vehicle) that selectively pushes or pulls the self-powered milling system in a desired direction. The milling system includes a cutting head, such as a cylindrical mandrel that includes a variety of bits attached thereon. The mandrel spins on an axis to break up and mill the paving material, and is powered by a milling system motor that speeds up production and enables the milling of very thick paving material (e.g., 8 inch thick asphalt) in a single pass.

Embodiments of the present invention further embrace a milling system having a carriage that follows the contour of the ground. The carriage provides stability during the milling process, allowing only the cutting head to move during the process, and may be selectively adjusted to provide cuts at various angles. In a further embodiment, the carriage includes a flush side to enable performance of precise edge milling.

In one embodiment, a breaker bar is coupled to the carriage. The breaker bar is continuously located at or near ground level to hold the asphalt down as it tries to lift up during the milling process. The breaker bar is further employed to assist in the breaking up the milled asphalt aggregate.

Figure 1A:
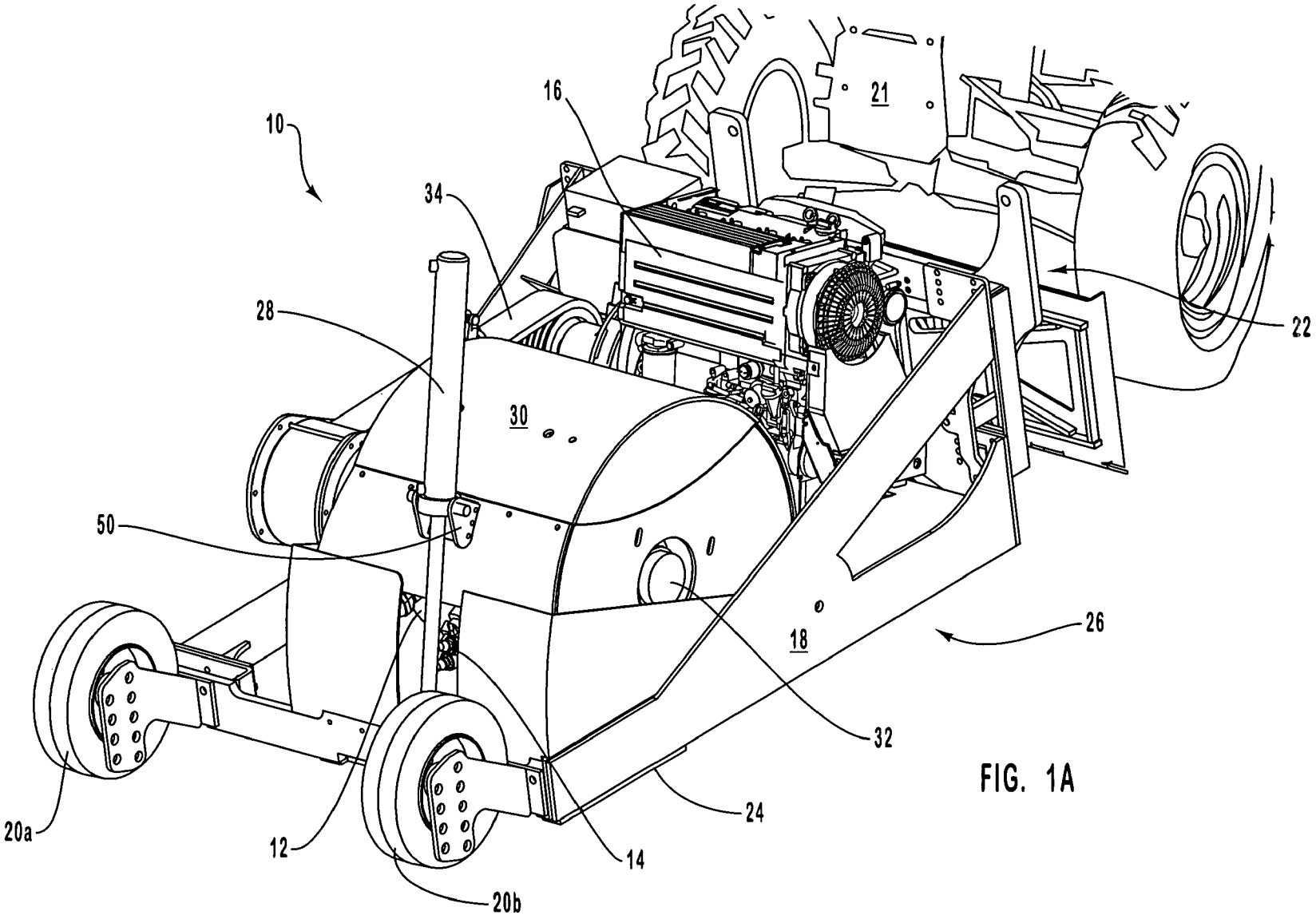
FIGS. 1A–1C illustrate perspective views of representative embodiments of the present invention.
Figure 1B:
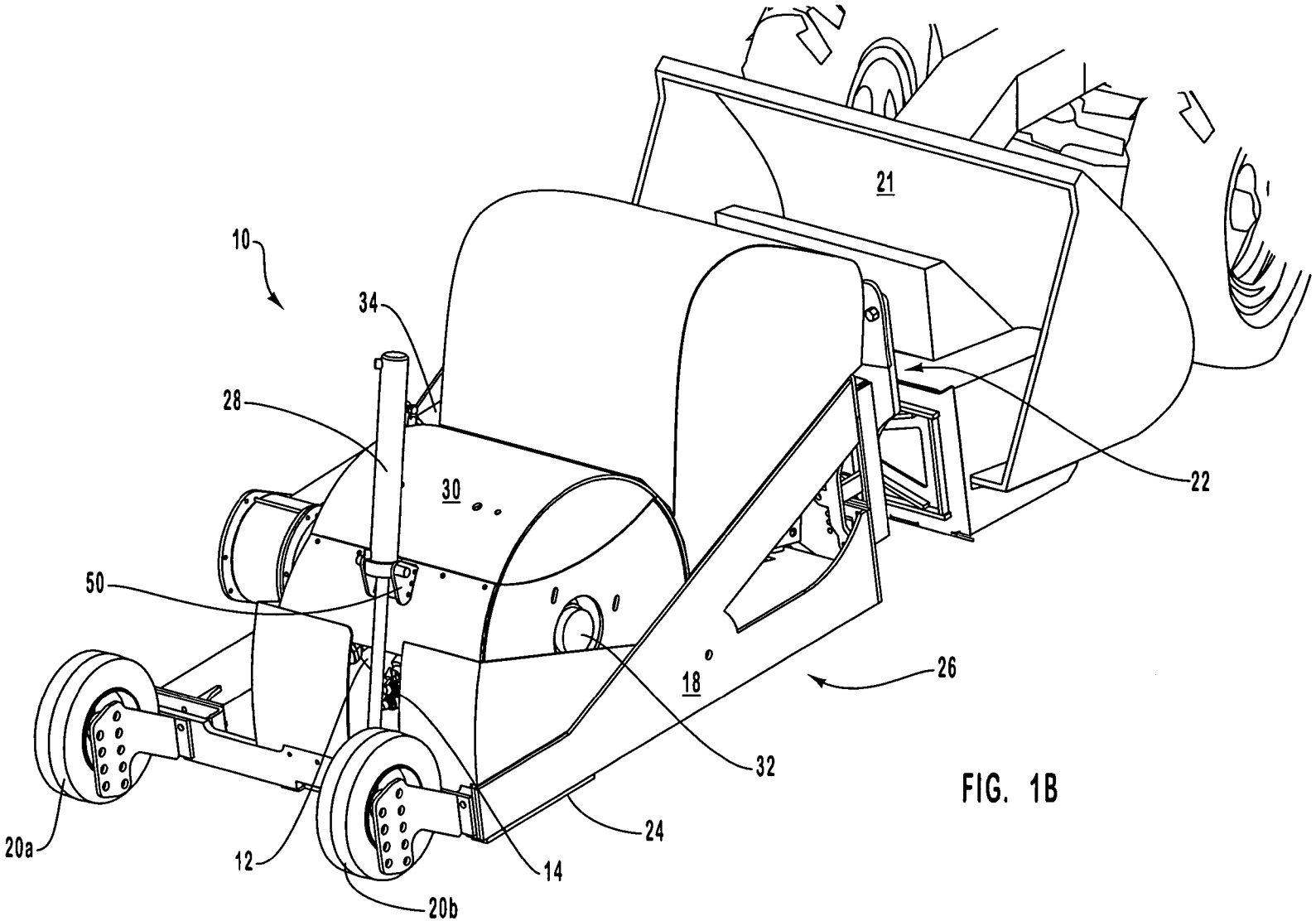
Figure 1C:
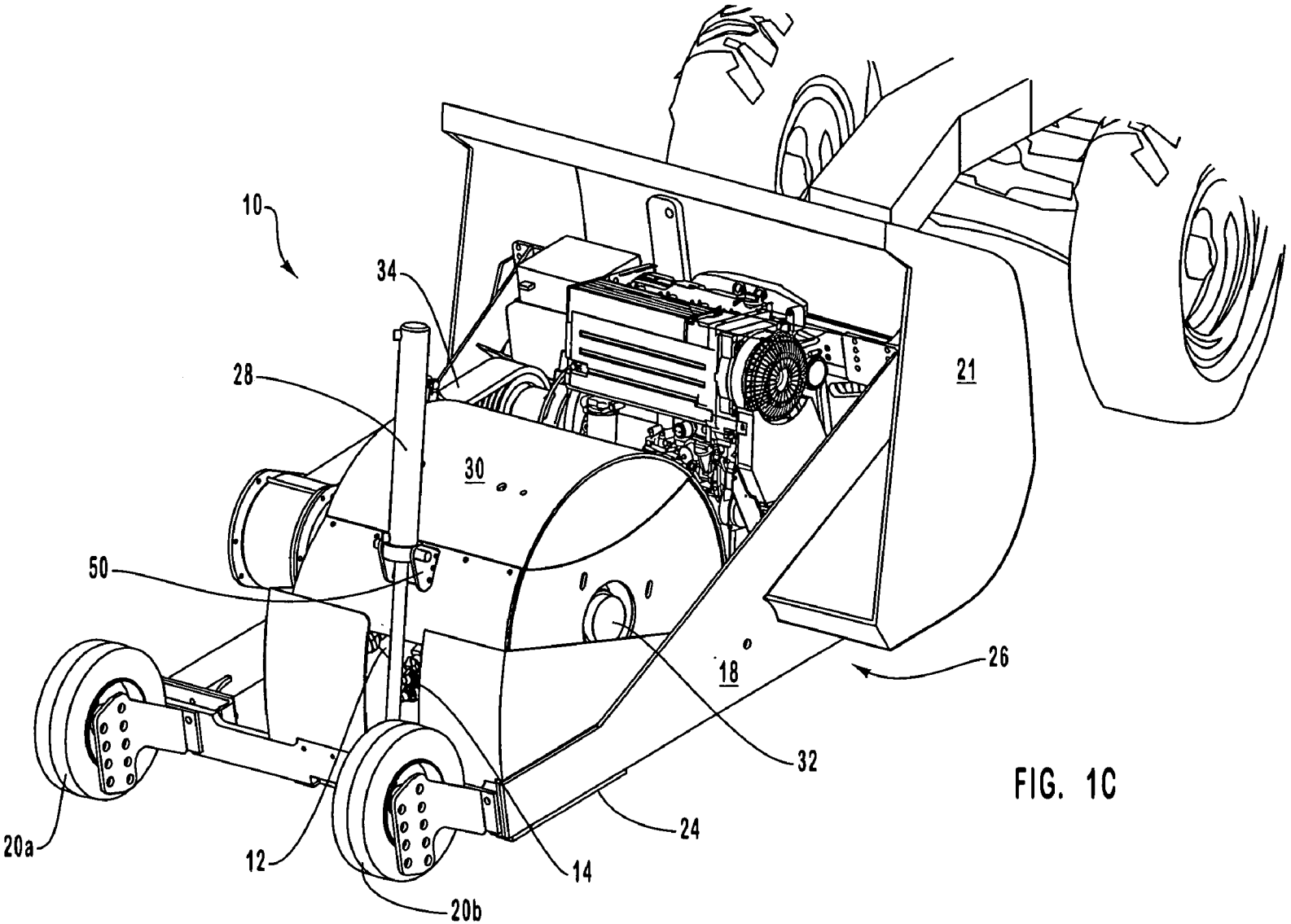

As provided above, embodiments of the present invention take place in association with a self-powered milling system that may be used to mill or grind paving material, and that may be configured to be coupled to a vehicle (e.g., a bobcat, steer-skid, back hoe, excavator or other vehicle), which selectively pushes or pulls the self-powered milling system in a desired direction. With reference to FIGS. 1A–1C, a representative embodiment of a self-powered milling system is illustrated as milling system 10, which includes cutting head 12 having bits 14 attached thereon, motor 16, carriage 18, wheels 20, and vehicle coupler 22.

In FIGS. 1A–1C, milling system 10 is configured to be coupled to a vehicle 21 using vehicle coupler 22. In the illustrated embodiment, vehicle coupler 22 is adjustable to allow for a coupling of milling system 10 to any type of vehicle. Once coupled to milling system 10, the vehicle (not shown) may be operated by a user to selectively push or pull milling system 10 in a particular direction.

Milling system 10 comprises a motor 16, which is separate from the motor of the vehicle. As such, milling system 10 is self-powered to enable the grinding or milling of paving material. More specifically, motor 16 is dedicated to the actuating of cutting head 12 in order to grind or mill paving material under milling system 10.

Figure 2:
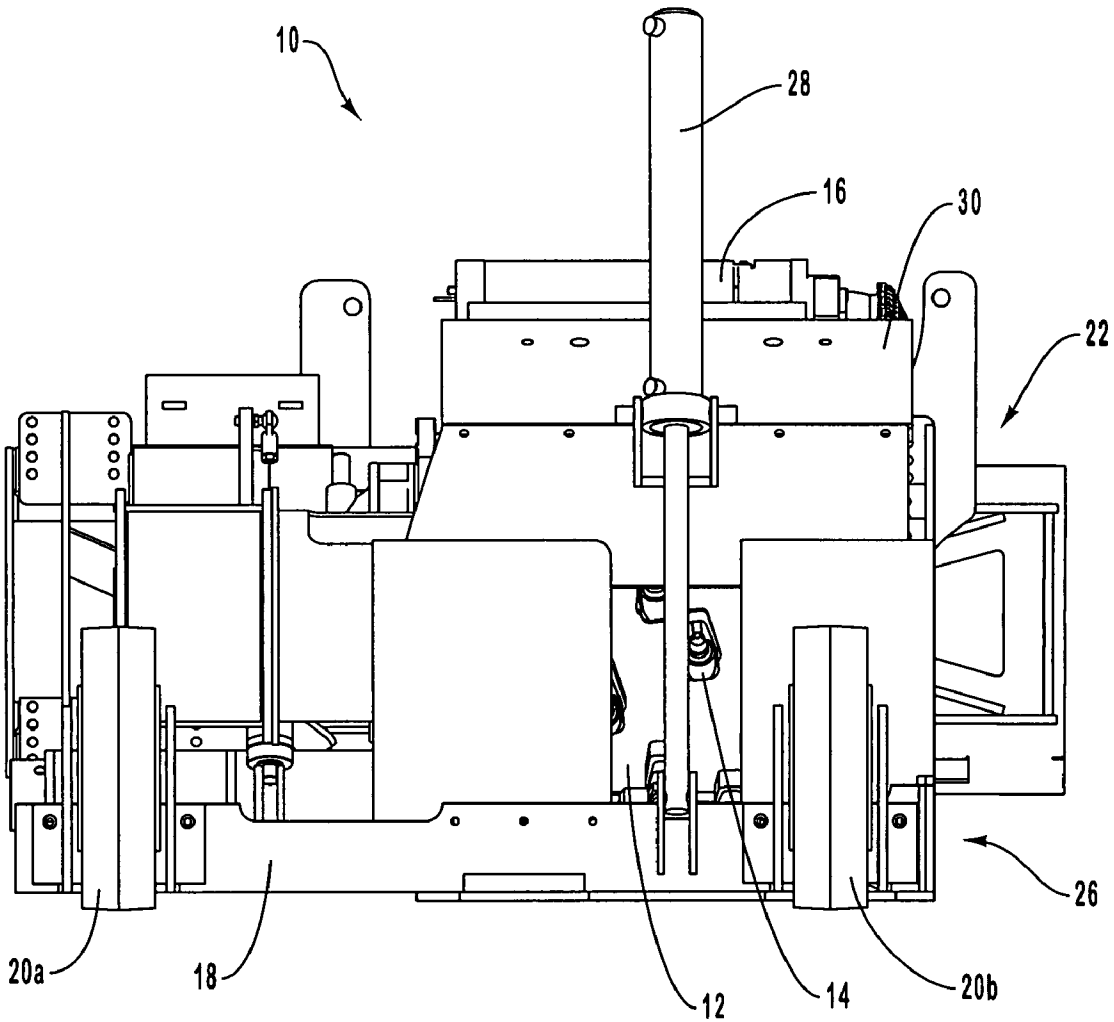
FIG. 2 illustrates a front view of the embodiment of FIG. 1A.
Figure 3:
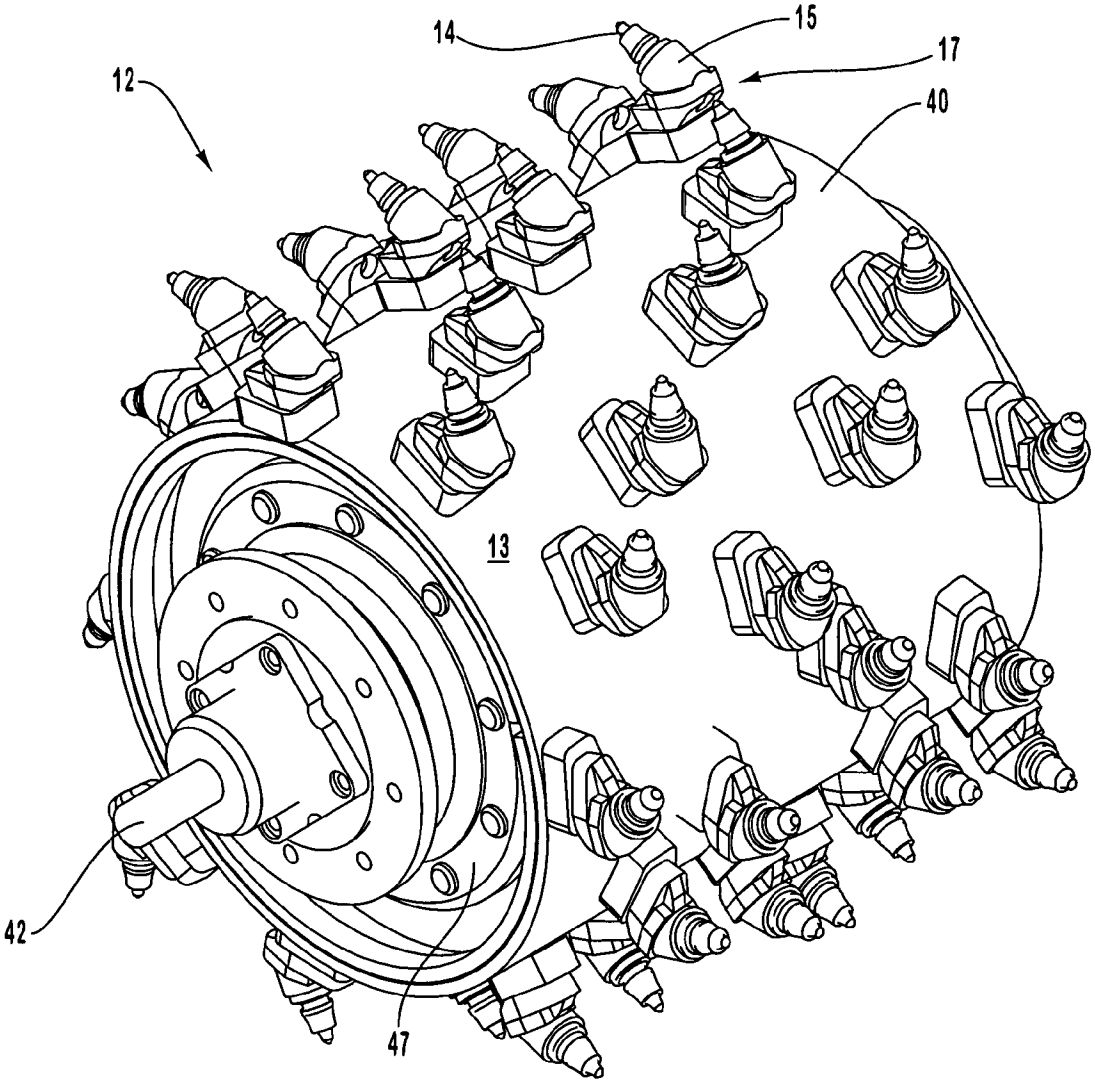
FIG. 3 illustrates a perspective view of a representative cutting head that may be used in association with the embodiment of FIG. 1A.

The use of cutting head 12 is more fully illustrated in FIGS. 2 and 3. In FIG. 2, a front view of milling system 10 is provided. Cutting head 12 is actuated by motor 16 and spins on an axis. As cutting head 12 is spinning, milling system 10 is pushed by a vehicle coupled thereto and mills paving material that passes underneath cutting head 12.

With reference now to FIG. 3, a perspective view of cutting head 12 is illustrated. In FIG. 3, cutting head 12 is a barrel-like attachment, known as a mandrel. Mandrel 13 spins and is pushed into the paving material. Bits 14 affixed to the exterior 40 of mandrel 13 engage and grind up the asphalt. Once ground, the asphalt may be easily removed and replaced.

In one embodiment, approximately forty bits are located on the exterior surface of cutting head 12. The bits 14 are scattered and patterned along the mandrel in a way that optimally enables pulverization and are exposed to the asphalt when the mandrel is in operation. In addition to the bits on the exterior of the mandrel, six bits are located at each end of the mandrel. The end bits prevent the mandrel from wedging into the paving material and from becoming stuck, and are known as"inside end bits."

Each bit 14 has a hardened or carbide tipped end, a stem, and a flat end at the bottom of the stem. The bits 14 are attached to a mandrel 13 by their insertion into channels or blocks of the mandrel 13. In one embodiment, the stem of a bit 14 has a spring collet surrounding it. When the bit is forced into a channel of a bit block and pressed down through the shaft, the spring collet squeezes against the stem to tightly fit the stem within the channel. An annular space on the bit that engages a lipped section of the top end of the bit shaft and locks the bit into the shaft is located between the bit stem and the tipped end of the bit. This annular space prevents the tip from leaving the shaft.

A bit 14 may be removed, such as when it has become tipped out, by pounding on the exposed flat end of a bit 14 seated within the shaft, and drive the bit 14 from the shaft. The bit is removable because despite its secure fit within the shaft, when the flat end is impacted, the spring collet is forced inward to contract and pass by the lip 17 of the shaft and is released from the annular space within the bit block 15.

Unfortunately, due to wear and tear, bits require replacement. For example, when an operator of milling system 10 hits a manhole, bits may become tipped out and need replacement. The need for replacing bits 14 arises frequently, therefore time efficient and cost effective techniques for replacing bits is greatly desired.

In the illustrated embodiment, and with reference back to FIG. 1A, a bit access is provided to facilitate bit removal from a top-level or a top portion of milling apparatus 10. The bit access is illustrated as removable cover 30, which is hinged to a casing that covers cutting head 12. In another embodiment, removable cover 30 is mechanically removable. Cover 30 provides access to bits 14 and facilitates access by eliminating the traditional requirement of having to access bits 14 from underneath a cold planer.

In the illustrated embodiment, removable cover 30 removes a top portion from a casing that covers cutting head 12 as well as a portion of either side of the casing. As such, in one embodiment, the top 60° to 90° of the cutter head 12 is exposed when removing removable cover 30. Since a portion on each of the sides of the casing is removable, access to the inside end bits is facilitated.

The use of motor 16 to drive cutting head 12 eliminates the need of traditional practices to steal power from the vehicle motor (not shown). The use of motor 16 exponentially speeds up production (it is approximately 4–6 times faster than traditional methods) since it enables the vehicle motor to be dedicated to moving system 10 and further enables up to approximately 8 inches of paving material to be milled in a single pass, as opposed to 2 inches by traditional methods. As such, the time required for an operator to perform the milling of paving material is greatly reduced since up to 8 inches can be milled with each pass.

Thus, for example, a traditional cold planer that claims it can mill up to 6 inches deep actually requires three separate passes, where each pass mills 2 inches of the paving material, in order to mill the total 6 inch deep paving material. Furthermore, a traditional milling head requires approximately 72 hp to run effectively. An average skid-steer motor doesn't generally produce more than 72 hp, which must be used to spin the milling head and to push the cold planer. Therefore, since so much of the power is required to spin the milling head, the amount of power available to push the cold planer is limited and results in an extremely slow process. Typically, the traditional cold planer is only able to mill up to about 2 inches deep and is only pushed at ½ mph.

In contrast, in accordance with the present invention, power (e.g., 72 hp or another amount of power) from the vehicle motor is provided to selectively move/push the milling system 10, and an additional amount of power (e.g., another 72 hp or another amount) is provided to spin the cutting head 12. The increased power yields increased efficiency in performing a milling job.

Embodiments of the present invention further increase the ability to mill paving material by providing a belt-driven system to power a cutting head. Traditionally, vehicles used to power a traditional cold planer are powered through the utilization of a hydraulic system, which yields a high efficiency loss. For example, a hydraulic system is typically about 60% efficient. Thus in the example above, where in a traditional procedure 72 hp is available to both move a traditional cold planer and to spin a cutting head, the actual power available due to the hydraulic system is 43.2 hp (72 hp multiplied by 60% efficiency is 43.2 hp). The other 28.8 hp is lost in heat.

Figure 4:
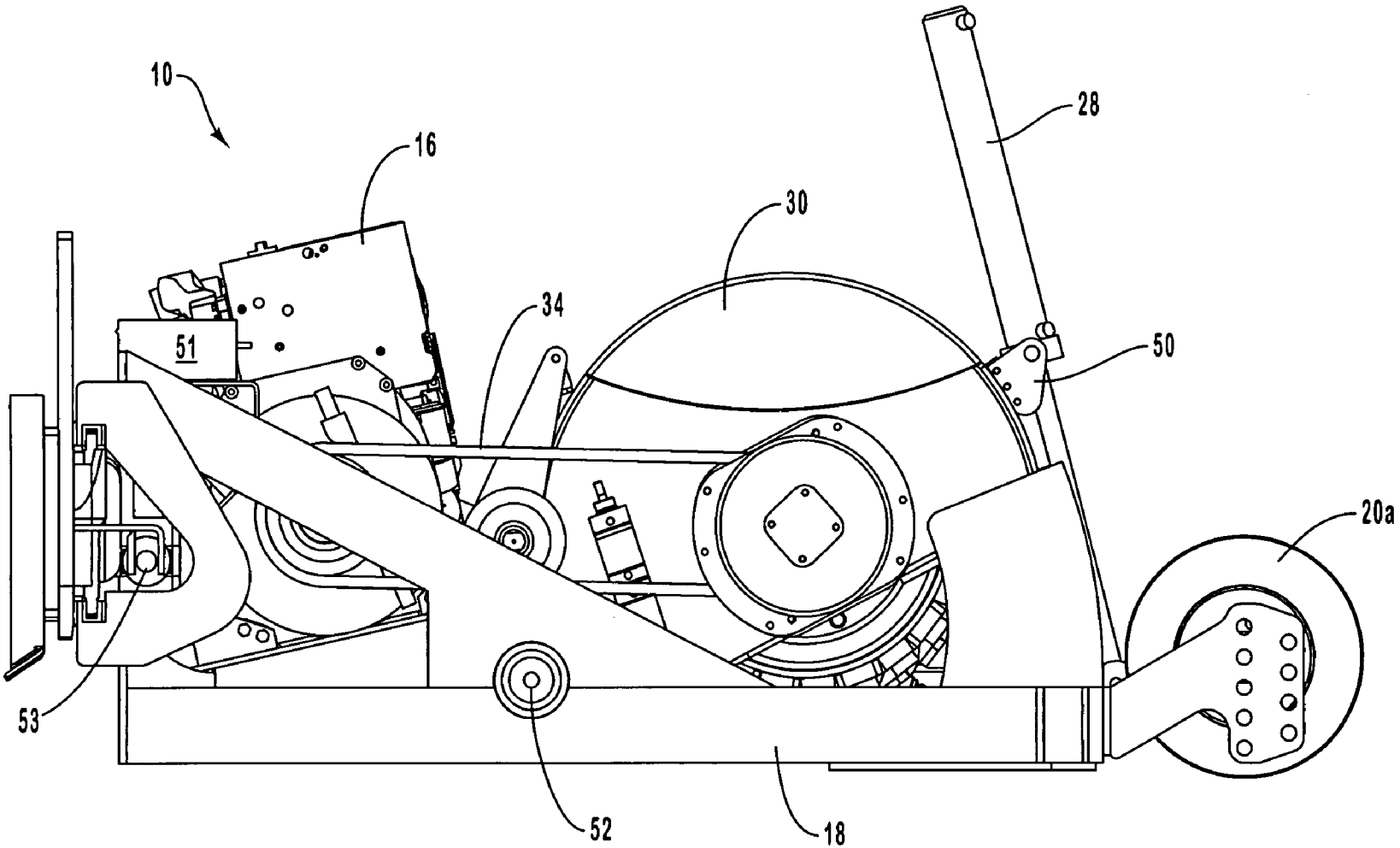
FIG. 4 illustrates a side view of the embodiment of FIG. 1A.
Figure 5:
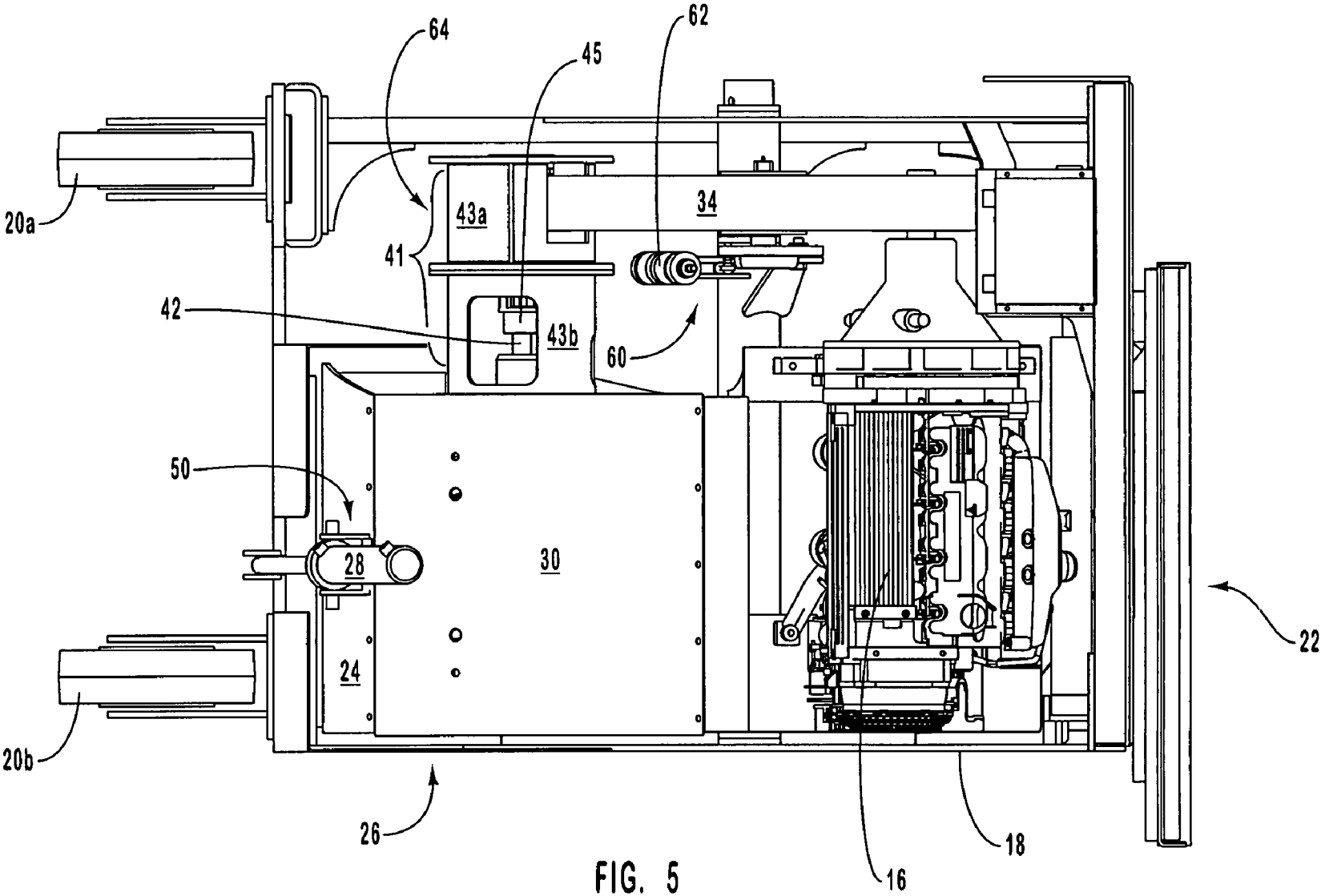
FIG. 5 illustrates a top view of the embodiment of FIG. 1A.

In contrast, embodiments of the present invention embrace the use of a belt-driven system 34, which provides 90% to 95% efficiency. Thus, where motor 16 provides 72 hp, milling system 10 is actually placing 64.8 (72 hp multiplied by 90% efficiency is 64.8 hp) on spinning cutting head 12. The belt-driven system 34 is additionally illustrated in FIGS. 4 and 5, which are respectively a top view and a side view of milling system 10, and includes a belt and a transmission 64 (FIG. 5). The belt couples shaft 42 (FIG. 3) of cutting head 12 with motor 16 to cause motor 16 to rotate shaft 42 and cause cutting head 12 to spin.

In one embodiment, system 10 further includes a belt tensioning system 60 (FIG. 5), such as an automatic or manual tensioner, that keeps the belt of the belt-driven system taut. In a further embodiment, the belt-tensioning system 60 includes a pneumatic air cylinder 62 (FIG. 5). As such, the belt may be set and aligned with low to no tension and locked into place. The belt-tensioning system 60 may then be engaged to apply tension to the belt in order to keep the belt taut. In one embodiment, the tension automatically adjusts to pressure. Therefore, when the system 10 hits, for example, an object while in use, the belts are automatically kept taut.

With reference back to FIG. 1A, milling system 10 provides a carriage 18, which sits near the ground and provides support. In one embodiment, carriage 18 sits approximately one-half inch above the ground. In the illustrated embodiment, wheels 20 are coupled to carriage 18. Carriage 18 provides pressure on cutting head 12.

Carriage 18 includes a flush side 26 that enables edge milling of paving material. For example, when milling system 10 is used to mill paving material that is located up against a vertical surface, milling system 10 is pushed along the vertical surface with the flush side 26 near the vertical surface. As such, the paving material may be milled within three to four inches of a vertical surface without touching the sides of milling system 10. The remaining portion of paving material may then be knocked off with a shovel. In contrast, traditional techniques required disassembly of a cold planer, which has caused instability in using the cold planer. The use of carriage 18 further allows for carriage 18 to potentially bump the vertical surface rather than cutting head 12, which would damage the vertical surface.

Carriage 18 is configured to be selectively adjusted to enable milling system 10 to be used in such a way as to cut on a particular angle or taper. Embodiments of the present invention embrace the ability to manually or hydraulically adjust the height of wheels 20. Milling system 10 maintains traction and support by allowing carriage 18 to follow the ground while cutting head 12 follows the set angle. In contrast, traction is lost in traditional techniques.

Milling system 10 may be manually or hydraulically tipped through the use of a cylinder system, such as cylinder 28 and bracket 50. For example, cylinder 28 is locked for safety reasons while moving milling system 10. Once milling system 10 is in use, cylinder 28, which allows cutting head 12 to raise and lower, may be manually or hydraulically actuated to allow cutting head 12 to move back and forth. In other words, cutting head 12 is allowed to float, which allows equal traction for the vehicle used. While milling, cutting head 12 is allowed to adjust to whatever angle it needs to in order to adjust and follow the contour of the ground. As such, multi-vector positioning of cutting head 12 is made possible.

Embodiments of the present invention embrace an improved method for entering the ground in order to mill paving material. In one embodiment, the vehicle is locked up in a home position and the arms of the vehicle are locked down with the tilt locked back. In this manner, nothing shakes or vibrates. Pressure is provided onto cutting head 12 by cylinder 28, and motor 16 engages cutting head 12 to allow for the milling to occur. As such, embodiments of the present invention may be dropped into any asphalt or paving material and pulverize the paving material into a fine gravel, similar to a road base.

Thus, a first cylinder, illustrated as cylinder 28, holds cutting head 12 down into the ground, pulling between carriage 18 and cutting head 12. A second cylinder controls the tilt that is enabled by milling system 10 and has the extra option of allowing cutting head 12 to float while in use to enable a more effective milling. In one embodiment, as illustrated in FIG. 4, system 10 pivots about pivot point 52. A third cylinder 53 (FIG. 4) is utilized to shift the vehicle hook-up.

With reference back to FIG. 1A, a bearing 32 faces outward and is protected from any debris, such as rocks, that may be spinning around. In one embodiment, a mound sets bearing 32 inside cutting head 12, but facing out to provide access to grease bearing 32. Alternatively, a user may pop bearing 32 out and remove it without disassembling any other portion of milling system 10. Alternatively, the cutting head 12 may be dropped out from system 10 and replaced with another cutting head. Thus, bearing 32 is placed inside the cutting head 12, facing out where it is still protected.

Also inside cutting head 12 is a well mount or a gear reduction planetary 47 (FIG. 3) that is mounted to one side of the drum and to the frame. On the other side of the drum an outboard shaft is mounted with an outboard bearing support to help the cutting head ride. This increases the life span of the gearbox and virtually provides an unlimited life span of the gear reduction planetary.

In a further embodiment, a remote control system 51 (FIG. 4) is utilized to provide control of the various cylinders in order to guide or steer milling system 10. In one embodiment, the remote control system utilizes a radio control system, such as an RF frequency, to provide the control. The system has an E-stop with a continuous transmission. If an operator gets far enough away from milling system 10, the system shuts down automatically.

In a further embodiment, milling system 10 includes an extended drive input 41 (FIG. 5). A shaft 42 with a flex coupling 45 that includes a couple of bearings that have two pilot tubes 43 that bolt up to cutting head 12 and support the belt 34 enable the engine to be flush on side 26 rather than having to overhang approximately 12 inches.

Embodiments in the present invention further embrace a large frame that holds still, just allowing the cutter head to move up and down. In other words, the vehicle frame is extended 10 feet or longer by the use of the carriage of the milling system. Furthermore, a breaker bar illustrated as breaker bar 24, is continuously located at ground level to hold the pavement down as it tries to lift up and is used to help break up the aggregate that has been milled.

Thus, as discussed herein, the embodiments of the present invention embrace systems and methods that provide increased stability, support and power in milling paving material. The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A self-powered milling apparatus that is configured to be selectively coupled to a vehicle and that may be used to mill paving material, said apparatus comprising:

a carriage configured to be selectively coupled to a vehicle;

a cutting head coupled to said carriage for use in milling the paving material, wherein said carriage is configured to follow a contour of the paving material to be milled and to provide stability during the milling of the paving material;

a breaker bar coupled to said carriage, wherein said breaker bar is configured to be continuously near ground level during the milling of the paving material to perform at least one of:

(i) holding the paving material down as the paving material tries to lift up during the milling; and (ii) helping break up aggregate of the paving material that has been milled;

a milling system motor coupled to said carriage, said milling system motor dedicated to driving said cutting head to mill said paving material, wherein said milling system motor is separate from any motor of the vehicle to provide a source of power to said milling apparatus independent of said motorized vehicle; and an extended drive input coupled to the carriage, wherein the extended drive input includes a shaft with a flex coupling that includes one or more pilot tubes that couple to the cutting head and support a belt to enable the cutting head to be flush with a side of the carriage to provide precise edge milling.

2. The self-powered milling apparatus of claim 1, wherein said carriage is selectively coupled to said vehicle via a vehicle coupler.

3. The self-powered milling apparatus of claim 2, wherein said vehicle coupler is adjustable to accommodate any type of vehicle.

4. The self-powered milling apparatus of claim 1, wherein said cutting head comprises a mandrel.

5. The self-powered milling apparatus of claim 1, wherein said cutting head comprises a plurality of removable and interchangeable bits affixed thereto and arranged in an identified manner to optimize exposure to said paving material and pulverization of said paving material.

6. The self-powered milling apparatus of claim 5, wherein said plurality of bits each comprise a stem portion, a tip removably coupled to said stem portion, and a flat end at the base of said stem portion, said plurality of bits capable of being removably coupled and secured to said cutting head within a plurality of respective matching bit blocks arranged about said cutting head, said bit blocks comprising a channel through which said bits are secured within.

7. The self-powered milling apparatus of claim 5, wherein said carriage further comprises a bit access to provide quick top-level access to said bits and facilitate and provide for removal of said bits.

8. The self-powered milling apparatus of claim 7, wherein said bit access comprises a removable cover that exposes a portion of said cutting head when removed.

9. The self-powered milling apparatus of claim 1, wherein said milling system motor allows for thick paving material to be milled in a single pass, thus significantly reducing overall milling time.

10. The self-powered milling apparatus of claim 1, wherein said milling system motor powers said milling apparatus via a belt-driven system, wherein said belt-driven system increases the efficiency of each milling job by transferring between 80 to 95 percent of said milling system motor's power to said cutting head, thus allowing a greater amount of said paving material to be milled in a single pass.

11. The self-powered milling apparatus of claim 10, wherein said belt-driven system comprises a belt and a transmission, said belt couples a shaft of said cutting head with said milling system motor to cause said milling system motor to rotate said shaft, which subsequently causes said cutting head to rotate about an axis of rotation.

12. The self-powered milling apparatus of claim 11, wherein said belt-driven system further comprises a belt tensioning system designed to maintain proper tensioning of said belt.

13. The self-powered milling apparatus of claim 12, wherein said belt tensioning system automatically adjusts the tension of said belt.

14. The self-powered milling apparatus of claim 13, wherein said tension is adjusted automatically in response to external forces encountered by said milling apparatus.

15. The self-powered milling apparatus of claim 1, wherein said carriage is further configured to provide pressure to said cutting head.

16. The self-powered milling apparatus of claim 15, wherein said carriage is adjustable to allow said cutting head and said milling apparatus to perform at least one of:

(i) tapered milling; and (ii) milling on any of a variety of angles.

17. The self-powered milling apparatus of claim 1, further comprising means for tipping, wherein said milling apparatus is allowed to adjust to any necessary angle to properly track and follow the contour of the ground.

18. The self-powered milling apparatus of claim 17, wherein said means for tipping comprises a first cylinder, said first cylinder allowing said cutting head to move up and down, said first cylinder also capable of being actuated to allow back and forth movement of said cutting head.

19. The self-powered milling apparatus of claim 1, wherein said milling apparatus comprises a pivoting point about which said cutting head rotates.

20. The self-powered milling apparatus of claim 1, wherein said cutting head is coupled to said carriage using a removable bearing, said bearing having a portion partially exposed to provide easy access for maintenance and removal purposes.

21. The self-powered milling apparatus of claim 1, wherein said cutting head comprises a gear reduction planetary mounted to said cutting head and said carriage.

22. The self-powered milling apparatus of claim 1, further comprising a remote control system to provide steering and guiding control of said milling system.

23. The self-powered milling apparatus of claim 1, further comprising a cylinder to hold said cutting head into the ground.

24. The self-powered milling apparatus of claim 23, further comprising a cylinder to shift said vehicle hook-up.

25. The self-powered milling apparatus of claim 1, wherein said carriage is extended and stationary to allow said cutting head to just move up and down.

26. A self-powered milling apparatus that is configured to be selectively coupled to a vehicle and that may be used to mill paving material, said apparatus comprising:

a carriage configured to be selectively coupled to a motorized vehicle, wherein said motorized vehicle functions to maneuver and position said milling apparatus;

a cutting head coupled to said carriage;

a motor coupled to said carriage, said motor dedicated to driving said cutting head to mill said paving material, thus providing a source of power to said milling apparatus independent of said motorized vehicle; and an extended drive input coupled to the carriage, wherein the extended drive input includes a shaft with a flex coupling that includes one or more pilot tubes that couple to the cutting head and support a belt to enable the cutting head to be flush with a side of the carriage.

* * * * *